United States Patent [19]

Chalabian

[11] Patent Number: 4,465,207

[45] Date of Patent: Aug. 14, 1984

[54] SINGLE ARTICLE VENDING MACHINE

[75] Inventor: Jack S. Chalabian, Huntington Beach, Calif.

[73] Assignee: K-Jack Engineering Company, Inc., Gardena, Calif.

[21] Appl. No.: 290,512

[22] Filed: Aug. 6, 1981

Related U.S. Application Data

[63] Continuation of Ser. No. 67,781, Aug. 20, 1979, abandoned.

[51] Int. Cl.[3] ..... G07F 11/14

[52] U.S. Cl. ..... 221/241; 221/279

[58] Field of Search ..... 221/155, 227, 232, 241, 221/242, 279; 194/2, 22, 37, 48, 51, 57, 59, 63, 65, 68, 75, 79, 88; 220/337, 338

[56] References Cited

U.S. PATENT DOCUMENTS

| | | | |
|---|---|---|---|
| 1,245,405 | 11/1917 | Turney | 221/241 X |
| 2,836,325 | 5/1958 | Erickson et al. | 194/75 X |
| 3,333,726 | 8/1967 | Belanger | 220/337 |
| 3,348,732 | 10/1967 | Schwarz | 221/279 X |
| 3,768,695 | 10/1973 | Pearson | 221/227 |
| 4,067,477 | 1/1978 | Chalabian | 221/1 |

FOREIGN PATENT DOCUMENTS

| | | | |
|---|---|---|---|
| 956549 | 4/1964 | United Kingdom | 220/337 |

*Primary Examiner*—F. J. Bartuska

*Attorney, Agent, or Firm*—Beehler, Pavitt, Siegemund, Jagger & Martella

[57] ABSTRACT

A number of improvements to the single article vending machine of U.S. Pat. No. 4,067,477 are disclosed. An angled catch has been provided to prevent the platform which holds the articles from being depressed by a customer, thereby defeating one mode of theft. The provision of a biasing spring greatly facilitates the adjustment of the width of the slot through which the articles are withdrawn. Other improvements enable the machine to operate more smoothly and dependably by insuring that the vended articles are withdrawn easily from the machine and without becoming skewed or jammed in the slot. An improved mounting bracket facilitates proper mounting of the protective cover plate by the operator after the machine has been serviced.

5 Claims, 11 Drawing Figures

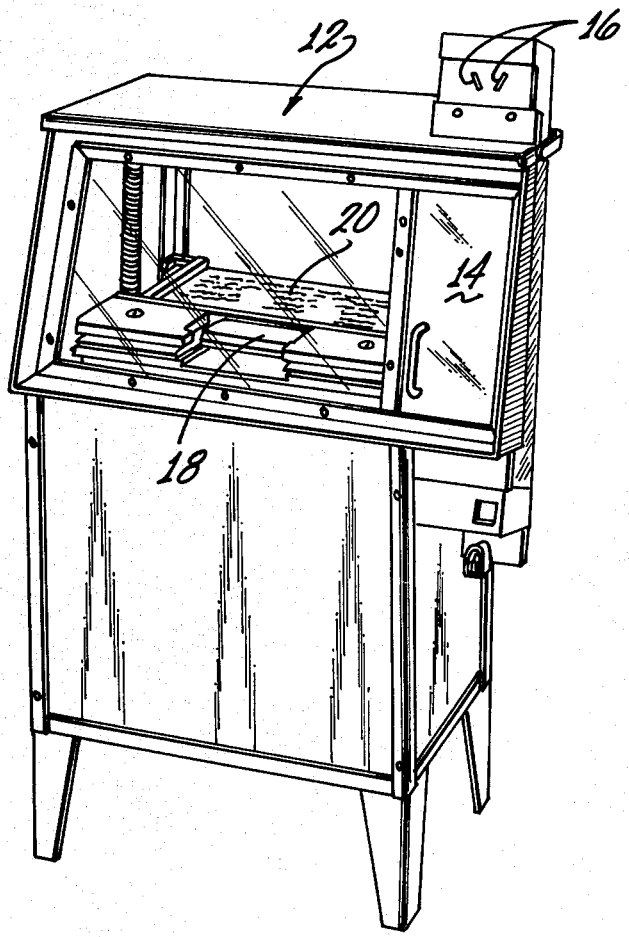
FIG. 1
FIG. 3
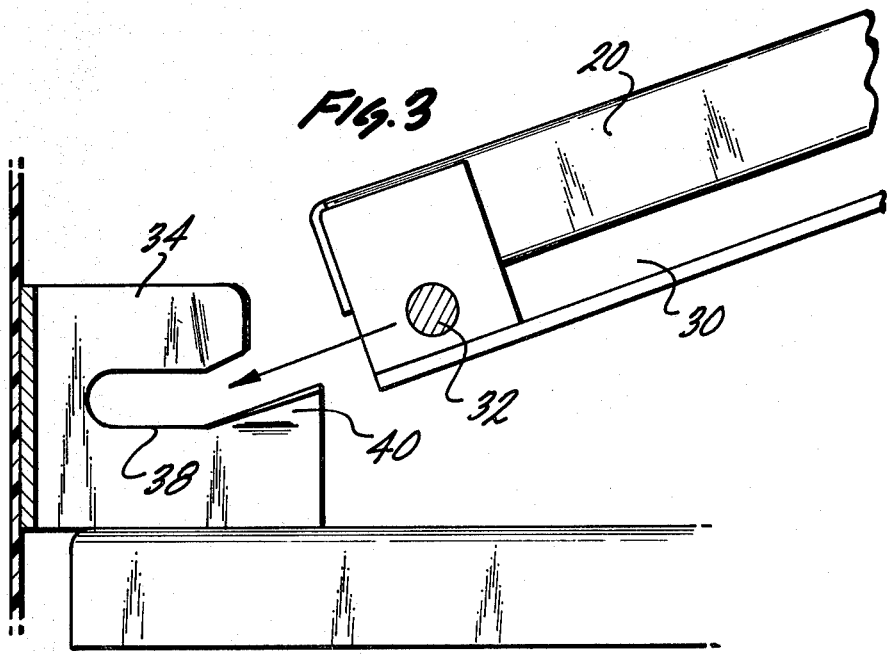

SINGLE ARTICLE VENDING MACHINE

This is a continuation of application Ser. No. 067,781 filed Aug. 20, 1979 now abandoned.

BACKGROUND OF THE INVENTION

In U.S. Pat. No. 4,067,477 issued Jan. 10, 1978 to Jack S. Chalabian, for a SINGLE ARTICLE VENDING MACHINE, there is described a vending machine of the type used for vending newspapers and like articles, and including means to prevent more than one article from being removed from the machine each time the access door is opened by depositing certain coins into the machine. The disclosure of U.S. Pat. No. 4,067,477 is incorporated by reference into the present specification, and an understanding of U.S. Pat. No. 4,067,477 is deemed essential for a full understanding of the present specification. The present specification discloses a number of improvements to the single article vending machine disclosed in U.S. Pat. No. 4,067,477. In view of the extensive discussion of the background and structure of the single article vending machine given in U.S. Pat. No. 4,067,477, it will not be necessary to repeat that information here, and the discussion in the present specification will embrace mainly the improvements in the machine.

SUMMARY OF THE INVENTION

In the single article vending machine disclosed in U.S. Pat. No. 4,067,477, a stack of newspapers or similar articles was stored on a vertically-movable spring-loaded platform, which urged the stack of articles upward against the underside of a protective cover located within the machine. It was found to be possible to defeat that machine, once the access door had been opened, by reaching into the machine and depressing the platform, and then manipulating the topmost article in the stack sidewardly and upwardly around the side of the protective cover. This mode of theft was relatively uncommon in practice because of the time and dexterity required. Nevertheless, this mode of theft has been eliminated in the improved vending machine of the present invention by the provision of means to prevent downward motion of the platform while the machine is vending the article. The means to prevent downward motion of the platform are enabled by an operator after he finishes servicing the machine and replenishing the supply of articles in the machine. Although a ratchet having a pawl enabled by the operator could be used to limit the platform motion to the upward direction, in a preferred embodiment of the present invention, the desired result is accomplished by the provision of an angled catch which is enabled by a catch bar actuated when certain protective lids at the front of the protective cover are closed by the operator when he finishes servicing the machine. Normally, such lids are locked in a closed position, and this results in the catch bar remaining enabled until the machine is serviced again.

In the single article vending machine described in U.S. Pat. No. 4,067,477, the article nearest the cover is removable from the stack through an adjustable opening bounded above by the generally planar lower face of the protective cover and bounded below by an upper wall of a vertically-movable and lockable slide block. As disclosed in U.S. Pat. No. 4,067,477, the slide block is moved vertically to adjust the height of the opening by rotating captive screws which engage threaded openings of the upper wall of the slide block. After the vertical height of the opening has been thus adjusted, the captive screws are locked in rotation and thereafter protected from tampering by the protective lid referred to above.

In the unimproved machine, the upper wall of the slide block always remained suspended on the adjusting screws at the lowest possible position consistent with the extent to which the adjusting screw had been rotated. In order to adjust the height of the opening, it was necessary to rotate the adjusting screws to lower the upper wall of the slide block by an amount ample to permit the topmost article to be drawn by the operator into the adjustable opening. Thereafter, the adjusting screws were rotated to draw the upper wall of the slide block upwardly and into contact with the underside of the topmost article within the opening. An adjusting screw was provided at each end of the slide block, and it was difficult to be certain that the opening was adequate at each side to pass the article without squeezing it excessively. Because newspapers are folded at one edge, the opening would ideally be slightly larger at that end than at the other end.

Means are provided in the present invention to facilitate adjustment of the opening. In a preferred embodiment, this is accomplished by the use of a compression spring beneath the upper wall of the slide block, which urges the upper wall of the slide block against the underside of the uppermost article after it has been drawn into the opening. The proper height of the opening is thus established with the proper degree of squeezing of the article at each end of the slide block. Because the adjusting screw engages a threaded opening in the upper wall of the slide block, as the upper wall is driven upwardly by the aforesaid springs, the adjustment screw is pushed upwardly through a clearance hole in the protective cover. Thereafter, the adjustment screw is rotated until the bottom side of the head of the screw is flush with the surface of the protective cover. At that point, the height of the opening has been adjusted, and the adjusting screws are locked in position. After the topmost article has been withdrawn through the opening, upward movement of the adjusting screw above the protective cover is prevented by closure of a protective lid by the operator at the time he services the machine. In use, after the operator has loaded a stack of articles into the vending machine, he then depresses the upper wall of the slide block and pulls the uppermost article forward so as to protrude into the opening. He then releases the upper wall of the slide block which is urged upwardly against the protruding article by the springs, thereby establishing the height of the opening. Thereafter, the operator locks the slide block at the thus-determined position.

A number of improvements have been made to the protective cover of the vending machine to enable it to operate more smoothly and dependably, and particularly to facilitate withdrawal of the uppermost article in the stack, and to reduce the risk that the uppermost article might become skewed as it is being removed. A roller has been provided on the protective cover, and the axis of the roller is perpendicular to the direction in which the articles are removed, while a portion of the cylindrical surface of the roller extends slightly below the underside of the protective cover to provide a rolling contact between the uppermost article and the roller.

In accordance with the present invention, a guide flange is provided on the right end and on the left end of the protective cover. These guide flanges extend downwardly from the underside of the protective cover adjacent the right and left ends of the topmost article, and extend parallel to the direction in which the article is withdrawn to prevent the article from becoming skewed as it is withdrawn. The above-mentioned roller tends to cause the uppermost article to move preferentially in a direction perpendicular to the axis of the roller as the article is withdrawn; thus, the roller and the guide flanges cooperatively coact with the article to prevent it from becoming skewed.

In the unimproved vending machine disclosed in U.S. Pat. No. 4,067,477, the display cabinet included mounting brackets having a slot through which a rod extending across the rear of the protective cover and projecting beyond the left and right ends of the protective cover would fit to position the cover within the display cabinet and to prevent forward motion of the protective cover. In the unimproved version, the slot opened to the top and thereafter extended forward within the brackets. Some operators, it was found, became careless and failed to insert the rod properly into the slot. This difficulty is overcome in the present invention by the provision of a mounting bracket having a tapered slot which opens to the front and which extends rearwardly in the mounting bracket. In the present invention, forward motion of the protective cover is prevented by the interaction of portions of the cover with other structural elements of the vending machine. For this reason, the cover is inserted into the vending machine with the front end of the cover inclined above the rear end of the cover, the rods or pins are then inserted into the slots by the operator, and thereafter, the front part of the protective cover is lowered onto the stack of articles.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view of the improved machine of the present invention;

FIG. 3 is a side cross-sectional view in the direction 3—3 indicated in FIG. 2;

DETAILED DESCRIPTION OF THE PREFERRED EMBODIMENT

Figure 2:
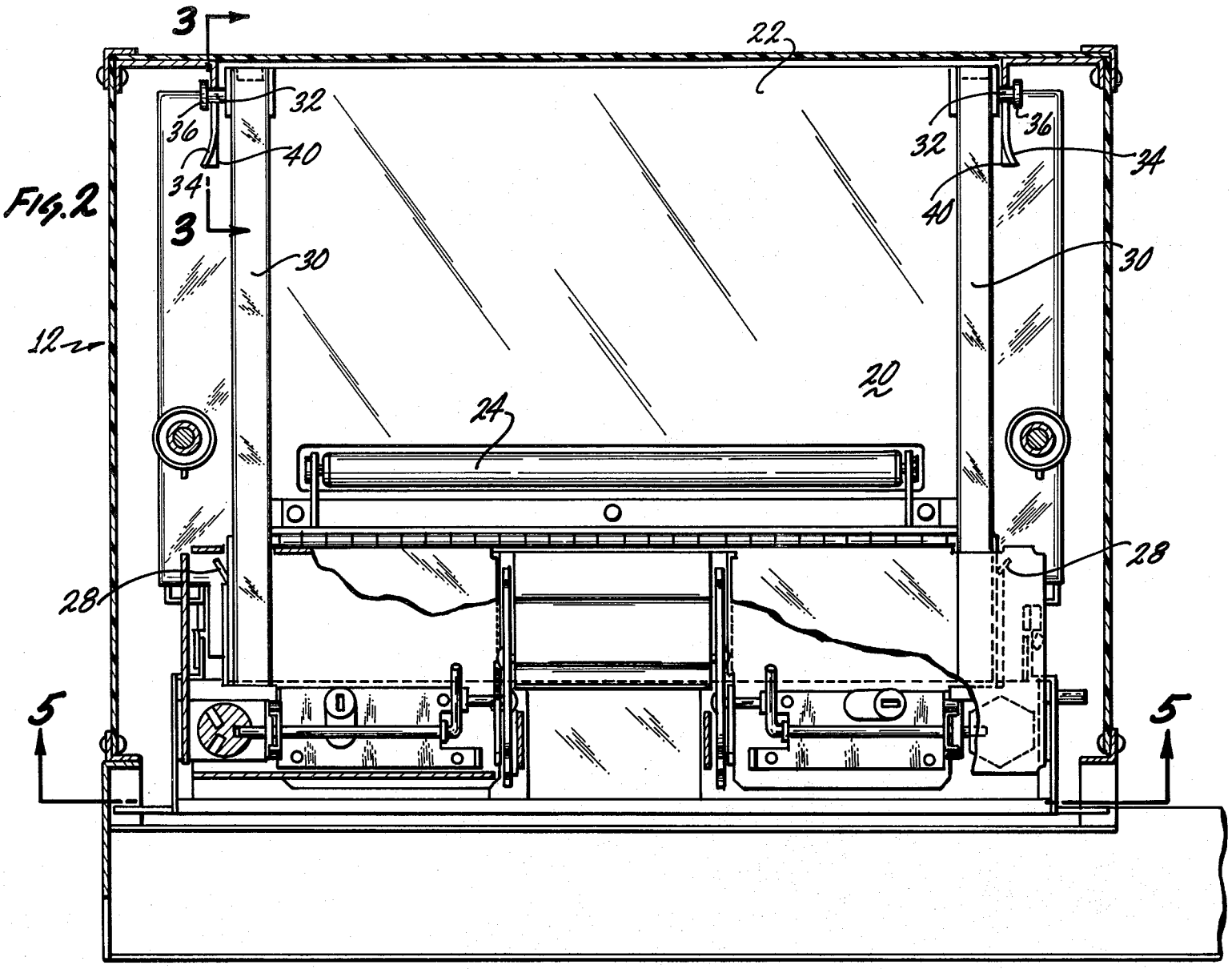
FIG. 2 is a cross-sectional top view showing the protective cover of the present invention.

Turning now to the drawings, in which like parts are denoted by the same reference numeral throughout, there is shown in FIG. 1 a perspective view of the improved single article vending machine of the present invention. As seen in FIG. 1, the vending machine includes a housing 12 which protects the articles from the weather and which provides means to limit access to the articles. An access door 14 is provided in the housing 12, but the access door 14 remains locked until a predetermined combination of coins has been inserted into the coin slots 16. After opening the access door 14, the customer raises the handle 18, thereby revealing a portion of one of the articles, which the customer then draws forward from underneath the protective cover 20. As will be described below, the improved single article vending machine of the present invention includes means to prevent the customer from removing more than one article once the access door 14 has been opened.

Figure 4:
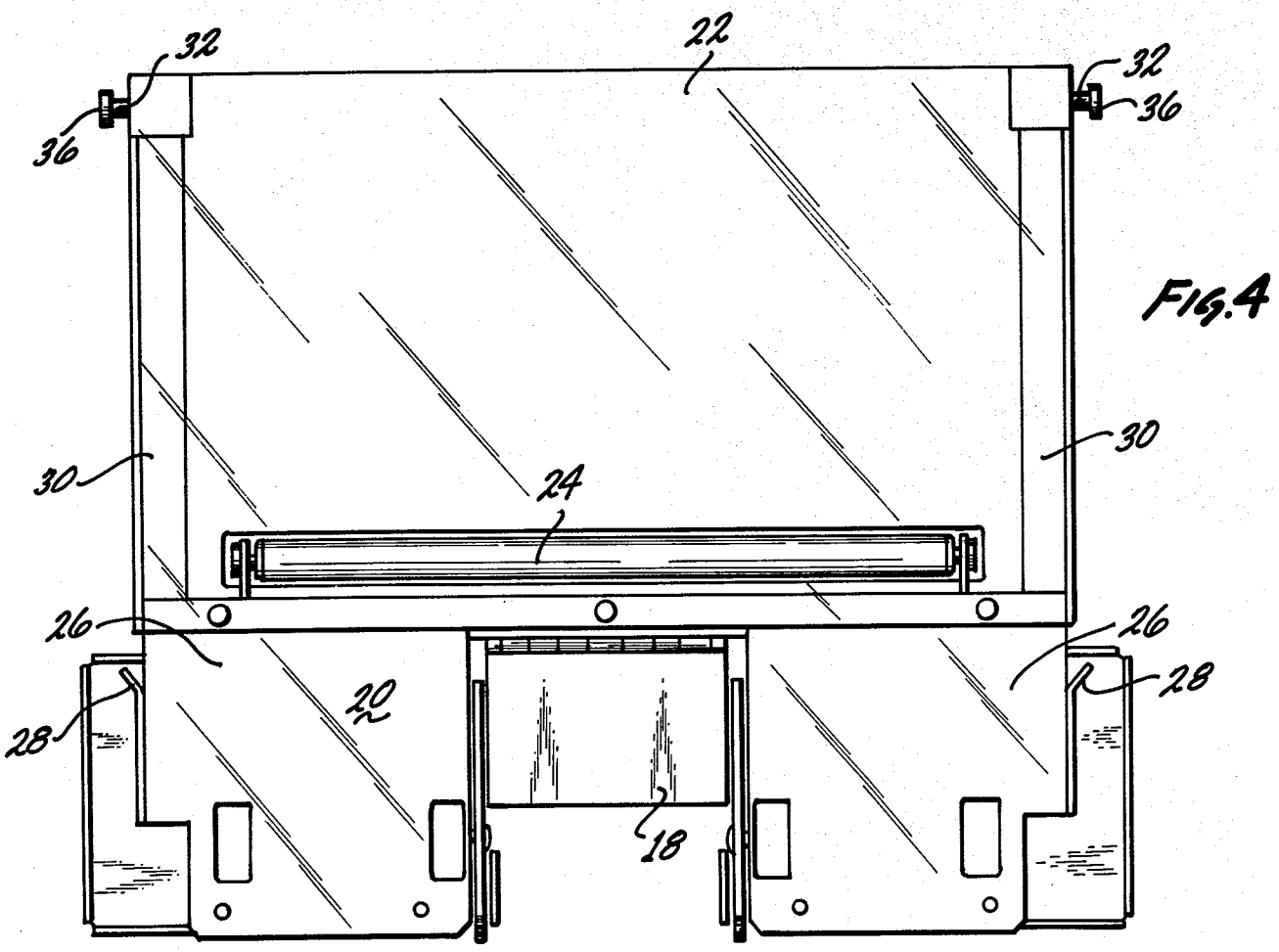
FIG. 4 is a bottom view showing the underside of the protective cover in a preferred embodiment.

FIG. 2 is a top view in cross section and partially cut away showing the protective cover 20 installed within the housing 12, while FIG. 4 is a bottom view of the protective cover 20, in a preferred embodiment.

As seen in FIGS. 2 and 4, the protective cover 20 includes a transparent window 22 which permits a portion of one of the vended articles to be seen, even though the articles lie beneath the protective cover 20.

Figure 6:
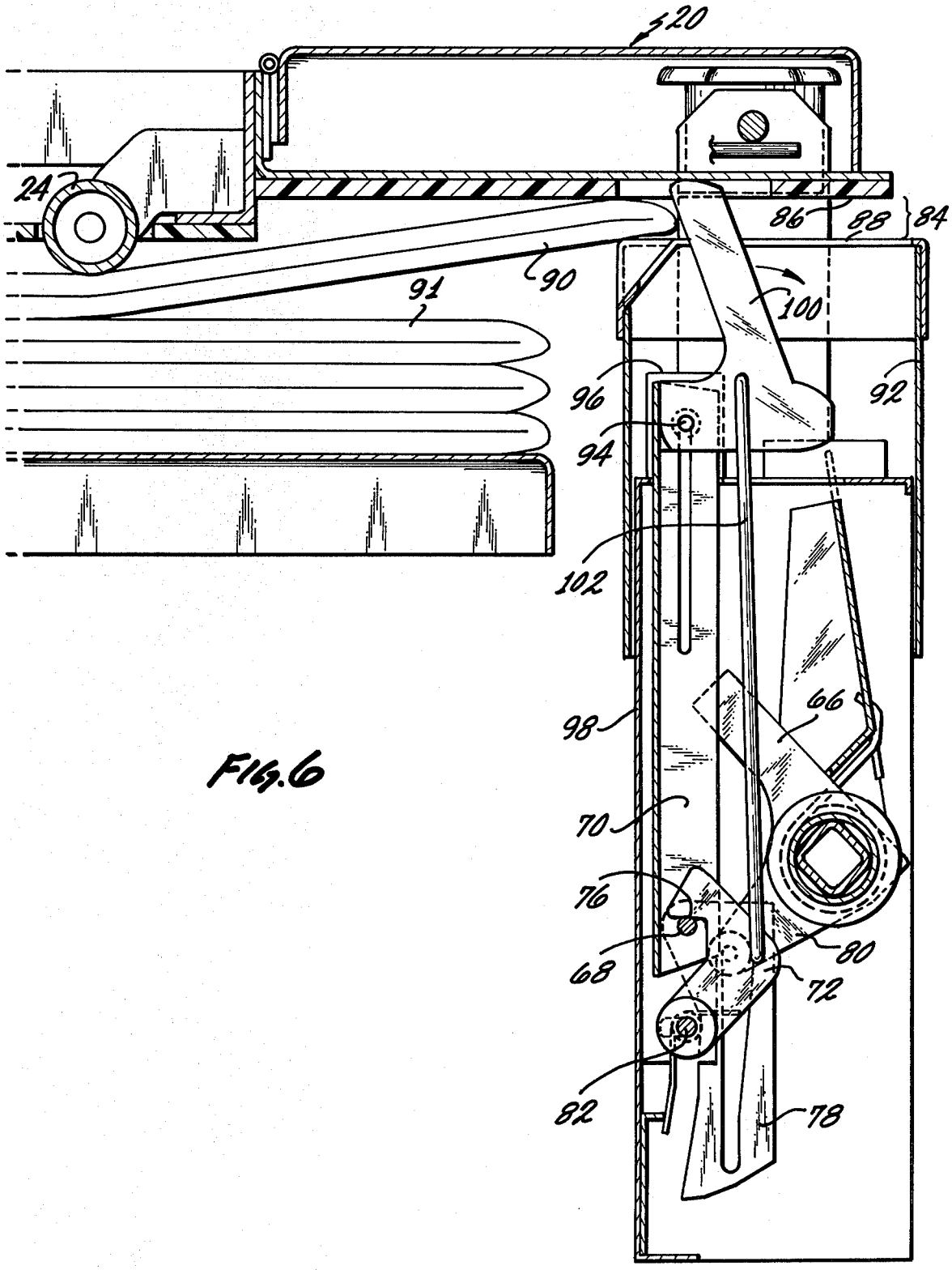
FIG. 6 is a side elevation view partially in cross-section showing the locking assembly immediately after the access door has been opened and prior to the withdrawal of the uppermost article.

The protective cover 20 further includes a roller 24 disposed in the protective cover 20 with its axis parallel to the plane of the cover and perpendicular to the direction in which the articles are withdrawn. The diameter of the roller 24 is sufficiently large that its cylindrical outer surface extends slightly below the lower surface of the transparent window 22, as shown in FIG. 6, so that as each of the articles is withdrawn from the machine it passes in contact over the cylindrical surface of the roller which thereby provides a rolling contact between the article and the protective cover 20 to facilitate withdrawal of the article from the vending machine.

Withdrawal of the articles from the vending machine is further facilitated by the provision of a facing 26 of low-friction material on the underside of the protective cover at its front portion. In a preferred embodiment, this facing may be of a plastic or teflon material.

A guide flange 28 is provided at each side of the protective cover 20 to insure that the articles do not become skewed or caught in the machine as they are being withdrawn. The guide flanges 28 are attached to the arms 30 and extend downward from the protective cover 20 toward the stack of articles and lie adjacent the right and left ends of the article nearest the cover.

Each of the arms 30 is provided at its rear portion with a pin 32 which extends laterally outwardly from the arm 30. Each pin 32 fits into a mounting bracket 34 which is affixed to the housing 12 of the machine.

When the machine has been serviced, that is, when a stack of articles has been loaded into the vending machine, the protective cover is inserted into place in the manner shown in FIG. 3. That is, the protective cover is moved downwardly toward the mounting bracket 34 so that the pins 32 will enter the slots in the mounting bracket. As seen in FIG. 3, the mounting bracket 34 includes a portion 38 defining a slot which extends frontwardly and upwardly and opens toward the front of the machine. This is a practical improvement over the type of slot used in an earlier version of the vending machine. Each of the pins 32 is provided with an enlarged head 36 which prevents the pin from moving laterally out of the slot. As seen in FIGS. 2 and 3, a portion 40 of mounting bracket 34 is angled to facilitate insertion of the pin 32 into the slot.

Figure 5:
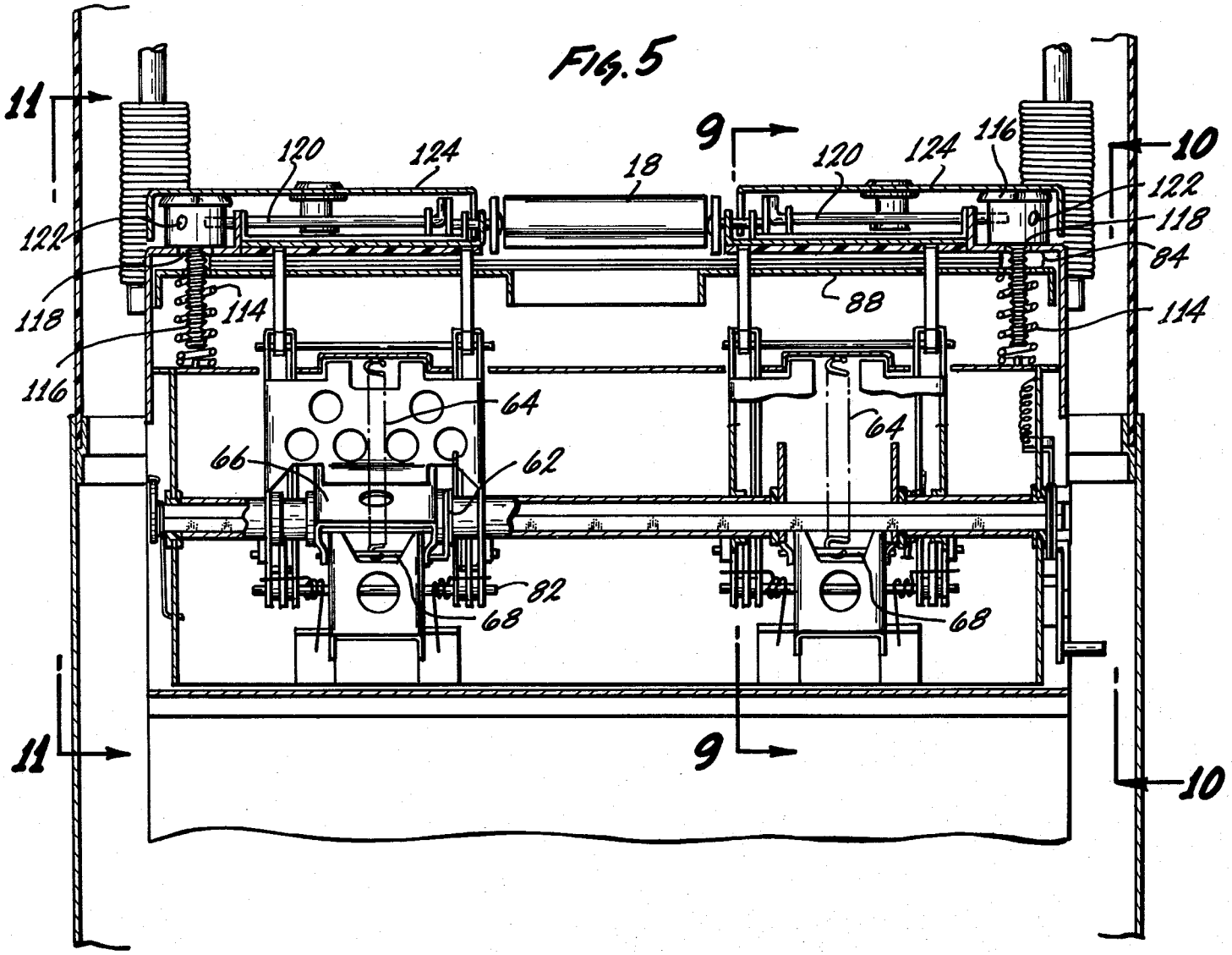
FIG. 5 is an elevation view partially in cross section in the direction 5—5 indicated in FIG. 2.
Figure 8:
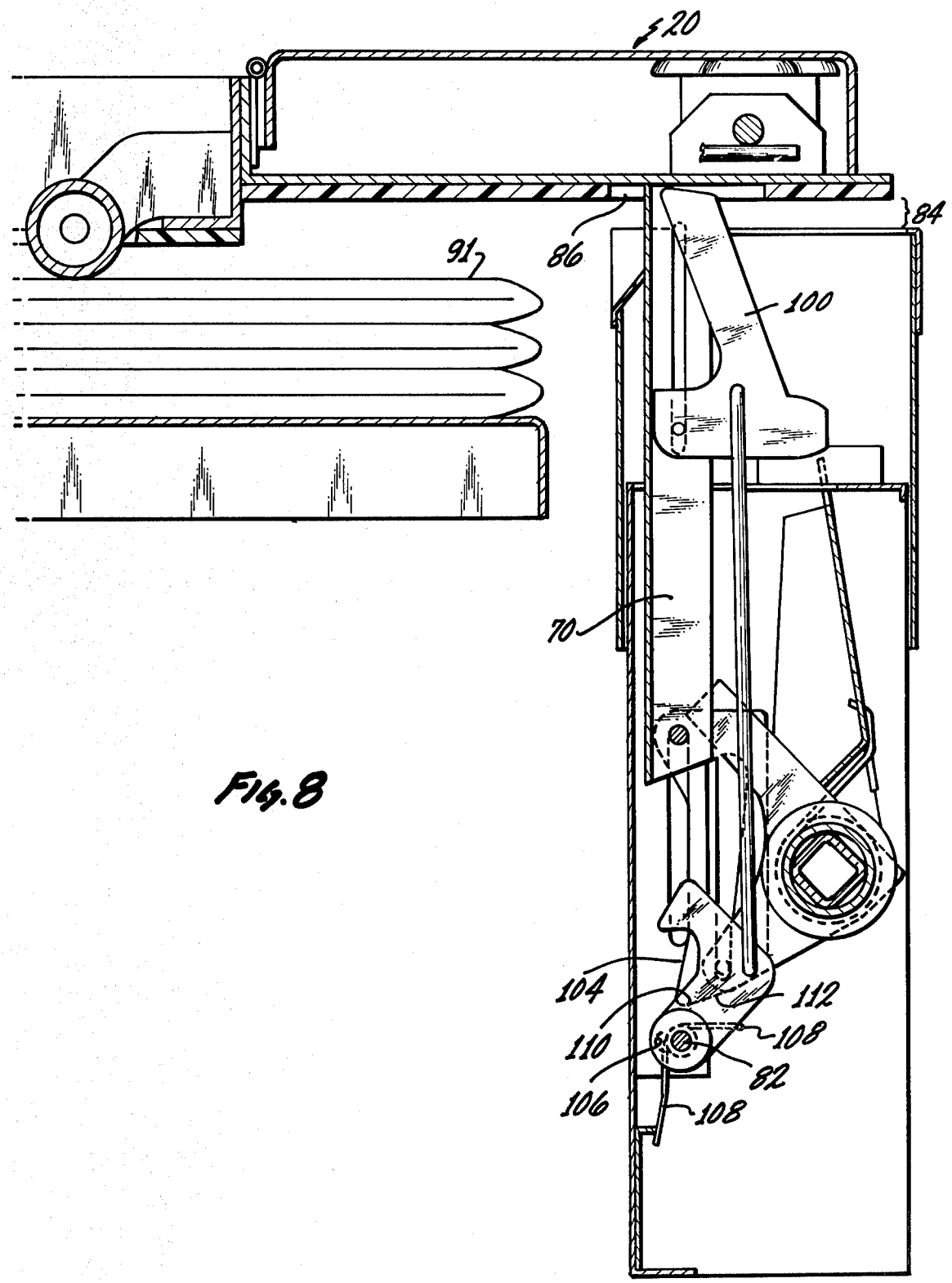
FIG. 8 is a side elevational view partially in cross section showing the locking assembly in its locked configuration after the uppermost article has been withdrawn.
Figure 9:
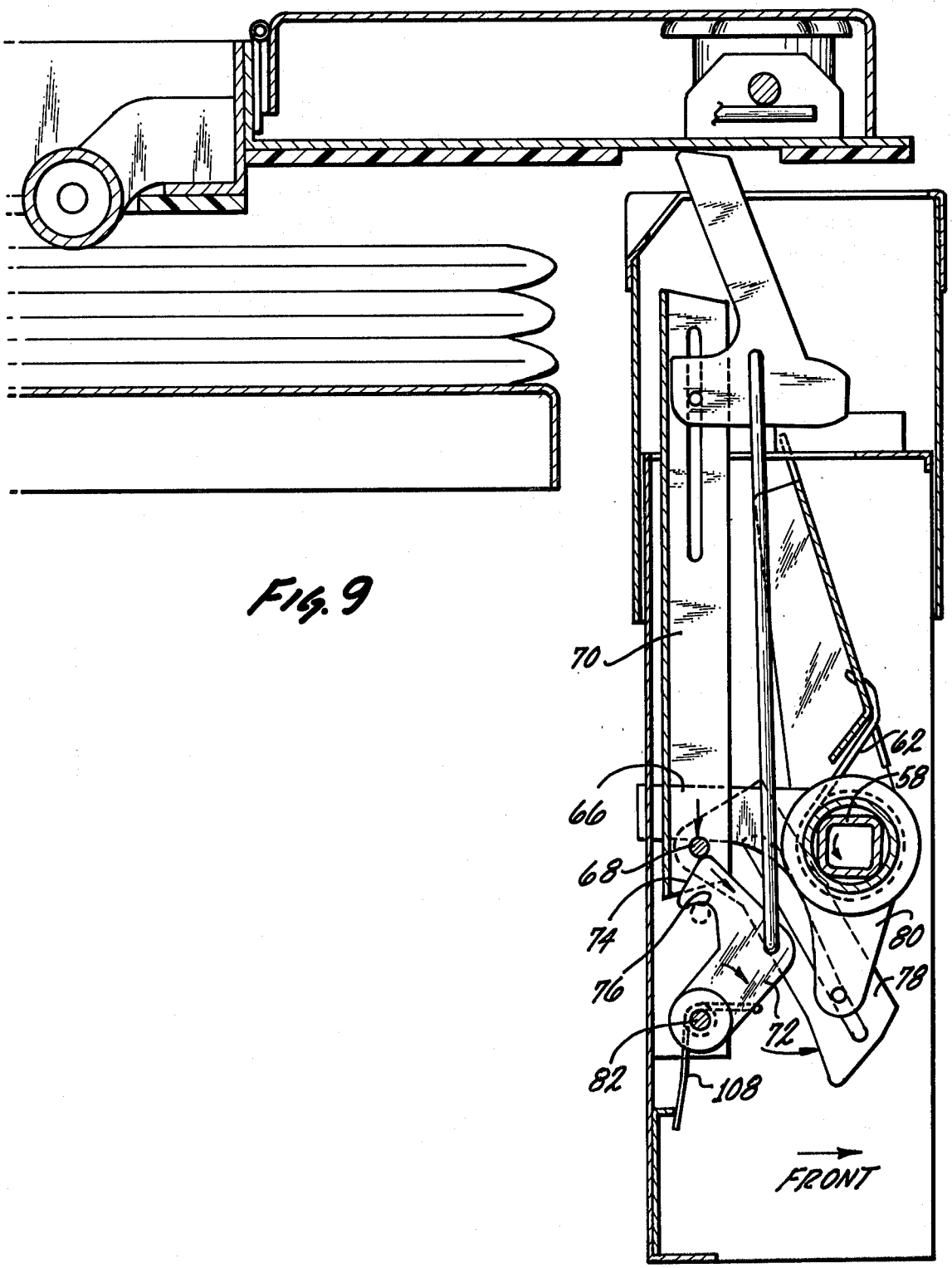
FIG. 9 is a side elevational view showing the configuration of the locking assembly as the mechanism is being cocked by opening the access door of the vending machine.
Figure 10:
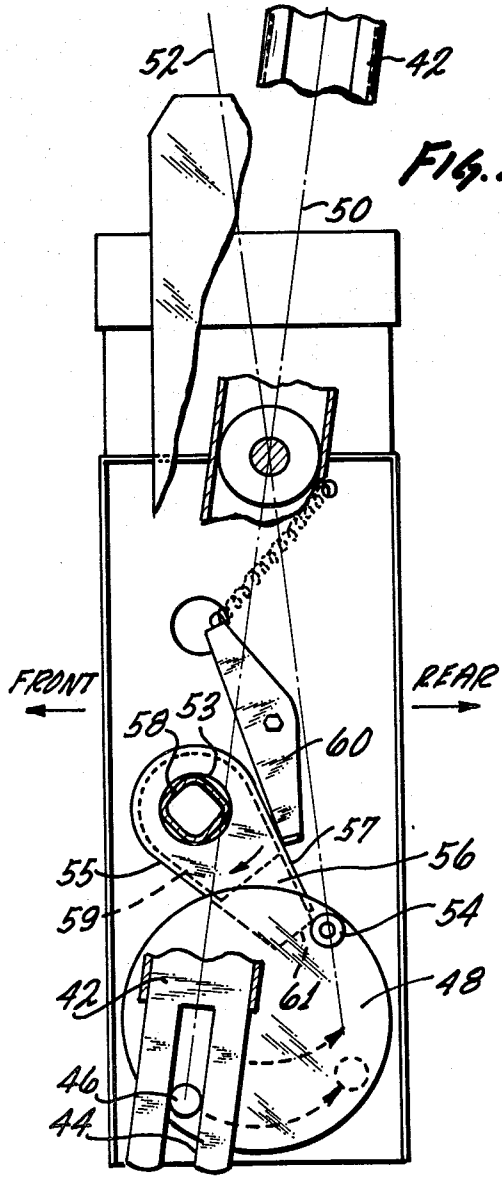
FIG. 10 is a side elevational view partially in cross-section showing the cocking mechanism; and, FIG. 11 is a side elevational view showing the mechanism for preventing depression of the platform.

FIGS. 5–10 show the locking mechanism employed in the preferred embodiment of the improved single article vending machine. FIG. 5 is a front view taken in the direction indicated in FIG. 2 and corresponding generally to FIG. 3 of U.S. Pat. No. 4,067,477. FIG. 10 of the present disclosure shows the mechanism for cocking the locking apparatus and corresponds generally to FIG. 4 of U.S. Pat. No. 4,067,477. FIGS. 6–9 of the present disclosure show successive stages in the operation of the locking mechanism, and FIGS. 6–8 of the present disclosure correspond respectively to FIGS. 6–8 of U.S. Pat. No. 4,067,477. These correspondences are mentioned, not to suggest a high degree of similitude, but rather to facilitate identification of the salient differences which are the improvements of the present invention.

Referring now to FIG. 10 of the present disclosure, the locking mechanism is cocked as the access door 14 is opened. This is accomplished through the use of an actuating lever 42 which is pivotally mounted to the access door 14 in the manner shown in FIG. 4 of U.S. Pat. No. 4,067,477. The lower end of the actuating lever 42 includes a slot 44 which engages a roller pin 46 that extends to the right from the wheel 48. As the access door 14 is opened, the longitudinal axis of the actuating lever 42 moves from a first position 50 to a second position 52, causing the wheel 48 to rotate in the counterclockwise sense indicated by the arrows. Mounted on the opposite side of the wheel 48 from the pin 46 is a roller pin 54 which extends leftwardly from the wheel 48. As the access door 14 is opened, rotation of the wheel 48 causes the second pin 54 to drive the lever 56 in the clockwise sense as indicated in FIG. 10. The lever 56 is in face-to-face contact with a second lever 59 which is rigidly fixed to the square shaft 58; the lever 56 includes a circular hole 53 which permits the lever 56 to rotate about the square shaft 58. The lever 56 further includes a leftwardly protruding portion extending from the edge 57 so that as the lever 56 is rotated in the clockwise sense, it effects clockwise rotation of the underlying lever 59 and with it the square shaft 58. During this clockwise rotation of the lever 56, the pin 54 initially bears against the edge 57, but at a later stage of the rotation, the pin 54 clears the end 61 of the lever 56. At this point, the springs 62 shown in FIG. 5 bias the lever 56 in the counterclockwise sense causing the lever 56 to be rotated by the lever 59 in the counterclockwise sense to approximately the position shown in FIG. 10, and during this return motion, the pin 54 bears against the edge 55 of the lever 56. During this return motion as the access door 14 is being closed, the pin 54 moves distally along the edge 55 and eventually passes around the end 61 of the lever 56. Once the pin 54 has cleared the end 61, the crank 60 pushes the lever 56 in the clockwise sense so that the pin 54 will return to its initial position at which it bears against the edge 57. During a portion of the return stroke, the lever 56 is driven in the counterclockwise sense relative to the underlying lever 59 by the pin 54. Such motion is possible because the edge 55 does not include a leftwardly extending portion of the type provided on the edge 57. Thus, the lever 56 in association with the lever 59 acts to drive the shaft 58 in the clockwise sense but does not torque the shaft 58 in the counterclockwise sense during the return movement. Each time the access door 14 is opened, the shaft 58 is forcibly rotated in the clockwise sense and this cocks the locking spring 64 shown in FIG. 5. The cocking action of the locking mechanism will now be discussed in connection with FIG. 9, which, as indicated in FIG. 5, is a view looking toward the right end of the machine, so that the clockwise rotation of the shaft 58 shown in FIG. 10 is shown as a counterclockwise rotation in FIG. 9.

As shown in FIG. 9, rotation of the shaft 58 in the counterclockwise sense causes the toggle lever 66, which is rigidly affixed to the shaft 58, to draw the rod 68 downwardly, thereby stretching the locking spring 64 (shown in FIG. 5). This same motion of the rod 68 also pulls the locking finger 70 downward. The catch 72 is spring-biased in the counterclockwise sense as shown in FIG. 9. As the rod 68 is moved downwardly by the toggle lever 66, the rod impinges on the sloping edge 74 of the catch 72 driving the catch 72 in a clockwise sense against the urging of the biasing spring 108. At a still later stage in the downward motion of the rod 68, the rod clears the edge 76 of the catch 72, which then moves under the action of the biasing spring in a counterclockwise sense to pass above the rod 68, thereby capturing it and thereby holding the springs 64 in their extended condition.

The lock lever 78 is pivotally connected to the rod 68, and during the cocking stroke, the arm 80, which is rigidly affixed to the shaft 58, pulls the lower end of the lock lever 78 toward the right as seen in FIG. 9, to clear the lock rod 82. At the end of the cocking stroke, the parts of the locking mechanism are disposed as shown in FIG. 6.

As shown in FIG. 6, the rod 68 is held in the cocked position by the edge 76 of the catch 72, thereby holding the locking fingers 70 in a retracted position as shown in FIG. 6.

As shown in FIG. 6, an adjustable opening 84 is bounded at its upper side by a generally planar lower surface 86 of the protective cover 20, and bounded on its lower side by an upper wall 88 of the vertically-movable and lockable slide block 92. The uppermost article to be vented is removed from the machine through the adjustable opening 84.

As shown in FIG. 6, stop members 100 extend into the adjustable opening 84 and come in contact with the article when it is pulled into the opening 84. The stop members 100 are pivotally mounted to the rod 94 which, in turn, is supported by the fixed mounting bracket 96 attached to the fixed wall 98.

Figure 7:
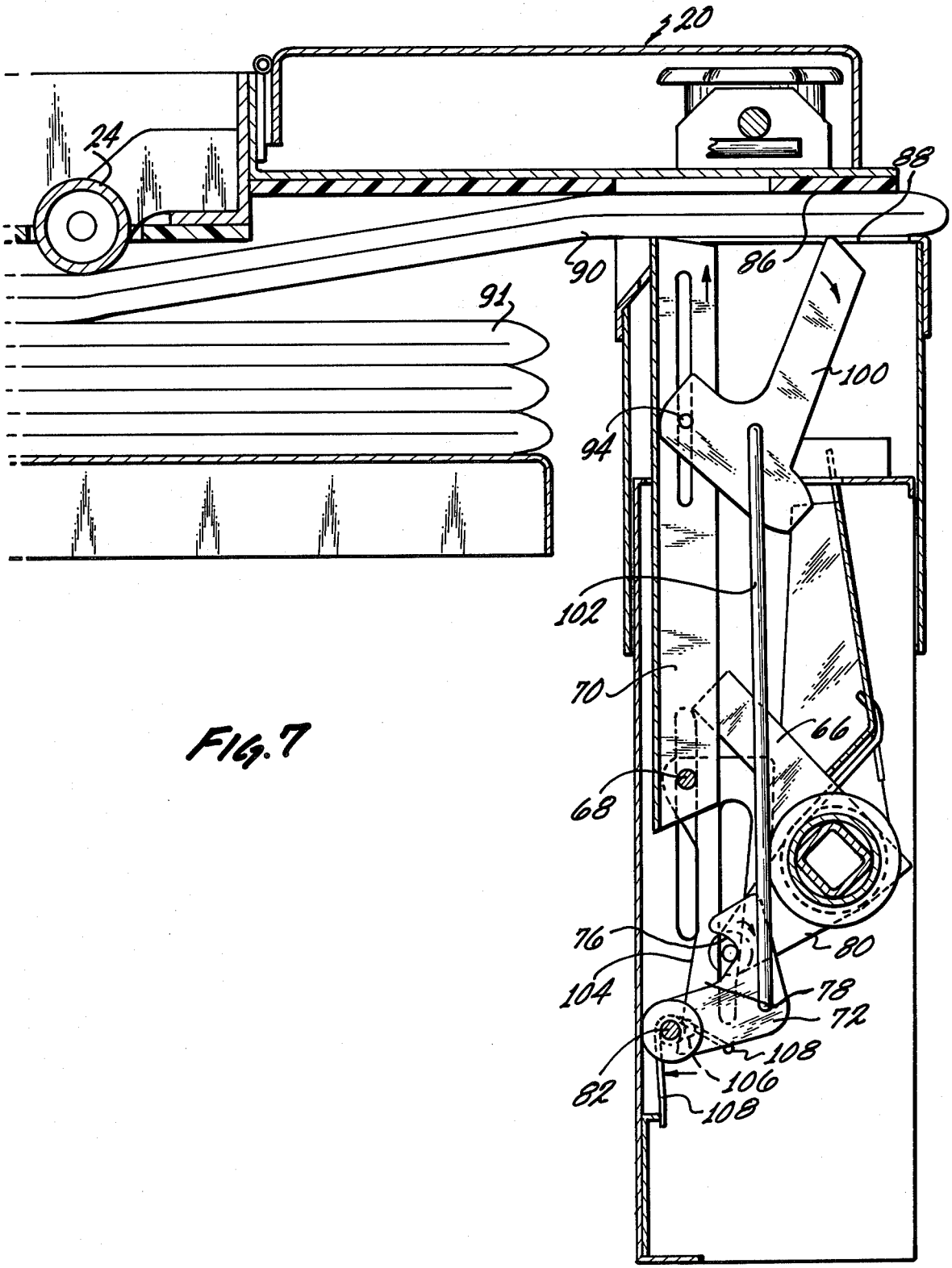
FIG. 7 is a side elevational view partially in cross section showing the configuration of the locking assembly as the uppermost article is being withdrawn.

The stop member 100 is pivotally connected to the catch 72 by the connecting rod 102. Rotation of the top portion of the stop member 100 in the counterclockwise sense in FIG. 6 is prevented by interaction of the catch 72 with the rod 68. Pivotal motion of the stop member 100 in the clockwise sense is produced as the article 90 is pulled through the opening 84. This clockwise motion of the stop member 100 pushes the connecting rod 102 downwardly, causing the catch 72 to pivot in the clockwise sense about the lock rod 82, thereby releasing the rod 68 so that it can move upwardly, propelling the locking finger 70 upwardly. The resulting configuration of the parts is shown in FIG. 7. It is noted that the top end of the locking finger 70 contacts the underside of the article 90 being withdrawn from the machine, and is urged upwardly against the underside of the article by the spring 64.

It should also be noted that as shown in FIG. 7, the lock lever 78 has been pulled vertically upwardly by the upward movement of the rod 68 and that the sloping lower edge 104 of the lock lever 78 cams the lock rod 82 toward the left in FIG. 7 within the slot 106 and against the rightward urging of the spring 108.

After the trailing edge of the article 90 has passed the top portion of the locking finger 70, the still upwardly urged locking finger 70 moves into the adjustable opening 84 and contacts the lower surface 86 of the protective cover 20, as shown in FIG. 8. The stop member 100 is returned to the position of FIG. 6 by the urging of the spring 108, which also urges the lock rod 82 rightwardly within the slot 106.

The incremental vertical movement of the locking fingers 70 between the position shown in FIG. 7 and the position shown in FIG. 8 is sufficient to permit the end 110 of the lock lever 78 to clear the rod 82 vertically. The rightward movement of the rod 82 within the slot 106 between the position shown in FIG. 7 and the position shown in FIG. 8 insures that the edge 112 instead of the edge 104 will contact the rod 82 in the event an effort were made to push the locking fingers 70 downwardly. This insures that the locking fingers 70 cannot be removed from the adjustable opening 84 by the customer, and the presence of the locking fingers 70 extending across the adjustable opening 84 prevents removal of a second article 91 from the machine. Thereafter, the uppermost article in the stack can be removed only by closing the access door 14, depositing the correct combination of coins into the coin slots 16, and again opening the access door 14 to return the locking mechanism to the cocked condition shown in FIG. 9.

In a preferred embodiment of the present invention, compression springs 114 of FIG. 5 are provided to urge upwardly the vertically movable upper wall 88 of the slide block against the underside of an article which has been drawn into the adjustable opening 84 in the manner shown in FIGS. 6 and 7. The adjustment screws 116 engage threaded holes in the upper wall 88 of the slide block, and pass through a clearance hole 118 in the lower portion of the protective cover 20. Thus, the adjustment screws 116 are pushed upwardly through the clearance hole 118 and must then be rotated to move them downwardly until the bottom side of the head of each of the adjustment screws is flush with the surface of the protective cover. At that point, the vertical height of the adjustable opening 84 has been adjusted, and therefore further rotation of the adjustment screws 116 is prevented by inserting the rods 120 into one of several horizontally directed holes 122 in the heads of the adjustment screws. After the topmost article has been withdrawn through the opening 84, upward movement of the adjusting screws 116 is prevented by contact with the lid 124 which was closed and locked by the operator at the time he serviced the machine.

Figure 11:
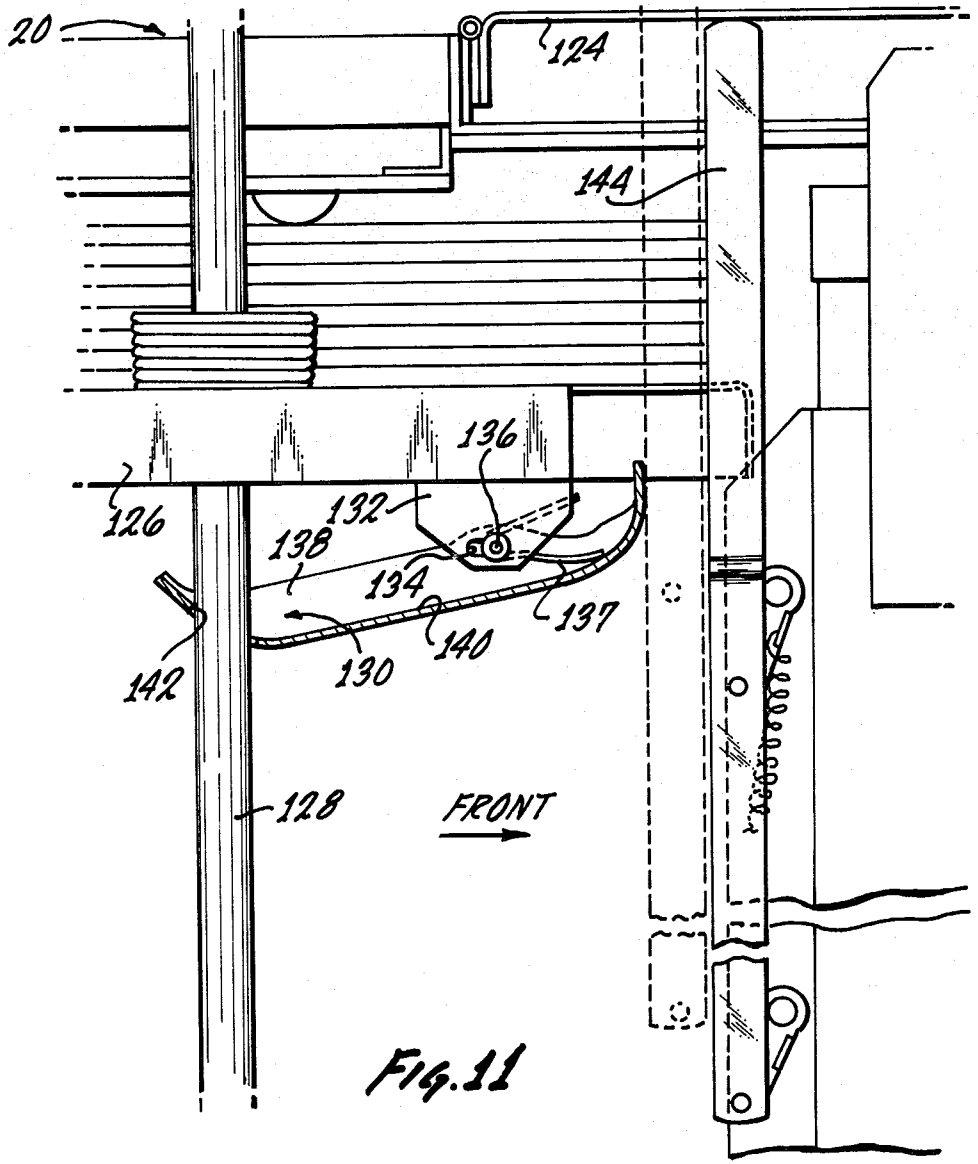

In servicing the machine, the operator places a stack of articles into the machine on the vertically movable platform 126 shown in FIG. 11. Thereafter, the operator depresses the upper wall of the slide block and pulls the uppermost article forward so that it protrudes into the adjustable opening 84 in the manner shown in FIG. 6. The operator then releases the upper wall 88 of the slide block which is then urged upwardly by the springs 114 of FIG. 5 against the protruding article, thereby establishing the vertical height of the adjustable opening 84. The operator then rotates the adjustment screws 116 until they are flush with the protective cover, and then the operator inserts the rods 120 into the holes 122 of the adjustment screws 116 to prevent further rotation. Finally, the operator closes the lids 124 and locks them to prevent tampering. When the access door 14 is then closed, the machine is ready for use by the customers.

It was found to be possible, in theory at least, to defeat the unimproved single article vending machine disclosed in U.S. Pat. No. 4,067,477. Although considerable dexterity, as well as time, are required, it is possible, once the access door has been opened, to reach into the vending machine and to depress the platform 126 of FIG. 11, and then to manipulate the uppermost article in the stack sidewardly and upwardly around the side of the protective cover, thereby to remove the article from beneath the cover. This mode of theft has been eliminated in the improved single article vending machine disclosed herein by the means shown in FIG. 11.

The stack of articles to be vended rests inside the vending machine on a spring-loaded platform 126 which assures that the stack is urged upwardly against the underside of the protective cover 20 regardless of how many newspapers are included in the stack at any particular time. The platform 126 is mounted for vertical movement on the rod 128. An angled catch 130 is pivotally attached to the platform 126 by a mounting bracket 132. The mounting bracket 132 includes a horizontally elongated slot 134 within which a pin 136 extending horizontally from the angled catch moves in the frontward and backward directions. The pin 136 is affixed to the angled catch 130, rather than to the mounting bracket 132.

The angled catch 130 shown in cross section in FIG. 11, has a generally U-shaped cross section including two vertically extending sidewalls 138 and a base 140. The base 140 includes a hole 142 of sufficient diameter to pass the rod 128, but not appreciably larger.

As the platform 126 is moved upwardly, the angled catch 130 is required to move upwardly with it. During such upward movement, any friction between the rod 128 and the edges of the hole 142 will tend to rotate the angled catch 130 in a counterclockwise sense, which will increase the projected cross section of the hole 142 in the direction of motion, thereby resulting in a reduction of such frictional forces. However, an attempted downward motion of the platform 126 will cause any friction between the walls of the hole 142 and the rod 128 to be amplified by virtue of the tendency of the angled catch 130 to be rotated in the clockwise sense, thereby reducing the projected cross sectional area of the hole 142 in the direction of motion. Thus, downward motion of the platform 126 causes the angled catch 130 to grip the rod 128 more tightly, thereby resisting the downward motion. The direction of the forces brought into play is such that the pin 136 is driven to the right end of the slot 134 when downward motion of the platform is attempted.

Downward motion of the platform is desired when the vending machine is serviced, and this is accomplished by the catch bar 144 which is typically mounted on the housing of the vending machine and which is spring-loaded so as to move up, when the lid 124 is raised, from the position shown in FIG. 11 in solid lines to the position shown by the dashed lines. In so moving, the catch bar 144 strikes the right hand end of the angled catch 130 driving the angled catch leftward in the slot 134 and pivoting the angled catch 130 in a counterclockwise sense about the pin 136. Both of these effects loosen the grip of the angled catch 130 on the rod 128, permitting the platform 126 to be lowered by the addition of more articles to be vended. A torsion spring 137 applies a gentle bias to the angled catch 130 in the clockwise sense to insure contact between the edge of the hole 142 and the rod 138 after the lie 124 has been closed again.

Thus, there has been described an improved single article vending machine which operates more smoothly and reliably and which includes additional anti-theft features. The foregoing detailed description illustrates a preferred embodiment of the invention, and it is to be understood that additional embodiments will be obvious to those skilled in the art. The embodiments described herein, together with those additional embodiments, are considered to be within the scope of the invention.

What is claimed is:

1. In a single-article vending machine of the type in which a stack of articles to be vended is stacked on an upwardly-biased platform vertically movable on a rod, which platform urges the articles upwardly against a generally planar face of a cover and in which the uppermost article nearest the cover is removable from the stack in a direction parallel to the cover following the depositing of a predetermined combination of coins into the vending machine and the opening of an access door in the vending machine, the improvement comprising:

an angled catch mounted to the underside of said vertically movable platform for simultaneous clockwise rotation and horizontal sliding movement away from said rod to engage said rod and lock said platform against downward movement, thereby to prevent users of the machine from depressing the stack of articles sufficiently to remove an article sideways from beneath said cover; and means enabled by an operator operative to pivot said catch in a counterclockwise direction and to slide said catch towards said rod to permit said platform to be lowered for replenishing the supply of articles in said vending machine.

2. An improved cover for use in a single-article vending machine of the type in which a stack of articles is urged against a generally planar face of a cover and in which the article nearest the cover is removable from the stack in a direction parallel to the cover following the depositing of a predetermined combination of coins into the vending machine and the opening of an access door in the vending machine, said improved cover comprising:

a roller having an axis parallel to the plane of the cover and perpendicular to the direction in which the articles are removed, the circumference of said roller extending between the generally planar face of said cover and the article nearest that face to facilitate removal of the article nearest the cover by providing a rolling contact between that article and said roller;

guide flanges extending from said cover toward the stack of articles, disposed adjacent the ends of the article nearest the cover, and extending generally parallel to the direction in which the article is withdrawn, to prevent the article from becoming skewed as it is withdrawn;

a pair of pins located at the rear of said cover and projecting sidewardly from it; and, a pair of mounting brackets affixed to said single article vending machine and each having a slot extending forwardly and upwardly and opening toward the front of the machine, and so spaced laterally as to permit said cover to fit between said mounting brackets with said pins extending through the slots.

3. The improvement of claim 2 wherein each pin terminates in a head of sufficient diameter to prevent the pin from being withdrawn laterally from the slot through which the pin extends.

4. An improved cover for use in a single-article vending machine of the type in which a stack of articles is urged upwardly against a generally planar lower face of a cover and in which the article nearest the cover is removable from the stack in a direction parallel to the cover following the depositing of a predetermined combination of coins into the vending machine and the opening of an access door in the vending machine, said improved cover comprising:

guide flanges extending downwardly from said cover toward the stack of articles, disposed adjacent the ends of the uppermost article nearest the cover, and extending generally parallel to the direction in which the article is withdrawn; and a roller positioned rearwardly of said guide flanges and having an axis parallel to the plane of the cover and perpendicular to the direction in which the articles are removed, the circumference of said roller extending between the generally planar face of said cover and the uppermost article nearest that face to space said article from said cover and thereby facilitate removal of the article nearest the cover by providing a rolling contact between that article and said roller and causing said topmost article to move preferentially in a direction perpendicular to said axis and parallel to said guide flanges as the article is withdrawn, said roller and said guide flanges thus cooperatively coacting with said article to prevent it from becoming skewed.

5. The improved cover of claim 4 further comprising:

a pair of pins located at the rear of said cover and projecting sidewardly from it; and, a pair of mounting brackets affixed to said single-article vending machine and each having a slot extending forwardly and upwardly and opening toward the front of the machine, and so spaced laterally as to permit said cover to fit between said mounting brackets with said pins extending sidewardly through the slots.

* * * * *